US007311555B1

(12) United States Patent
Burris et al.

(10) Patent No.: US 7,311,555 B1
(45) Date of Patent: Dec. 25, 2007

(54) FLIPPABLE SEAL MEMBER COAXIAL CABLE CONNECTOR AND TERMINAL

(75) Inventors: Donald Andrew Burris, Peoria, AZ (US); William Bernard Lutz, Glendale, AZ (US); Kenneth Steven Wood, Elmira, NY (US)

(73) Assignee: Corning Gilbert, Inc., Glendale, AZ (US)

( * ) Notice: Subject to any disclaimer, the term of this patent is extended or adjusted under 35 U.S.C. 154(b) by 0 days.

(21) Appl. No.: 11/607,759

(22) Filed: Dec. 1, 2006

(51) Int. Cl.
*H01R 13/40* (2006.01)
*H01R 13/52* (2006.01)

(52) U.S. Cl. ..... 439/594; 439/273

(58) Field of Classification Search ..... 439/587, 439/594, 271, 272, 273, 274, 588, 589
See application file for complete search history.

(56) References Cited

U.S. PATENT DOCUMENTS 4,410,162 A * 10/1983 Wlodkowski et al. ..... 249/215
5,342,218 A * 8/1994 McMills et al. ..... 439/578
5,467,848 A * 11/1995 Knez ..... 188/73.45
6,787,701 B2 9/2004 Yasuda et al. ..... 174/65 G
7,097,500 B2 * 8/2006 Montena ..... 439/587
7,118,416 B2 * 10/2006 Montena et al. ..... 439/584
7,179,100 B2 * 2/2007 Montena ..... 439/133
7,186,127 B2 * 3/2007 Montena ..... 439/277
2002/0009922 A1 * 1/2002 Ichio et al. ..... 439/587
2007/0134967 A1 * 6/2007 Montena ..... 439/277

* cited by examiner

*Primary Examiner*—Chandrika Prasad
(74) *Attorney, Agent, or Firm*—Joseph M. Homa; Matthew J. Mason

(57) ABSTRACT

A seal member for a coaxial cable connector has a generally tubular seal body with a first and second section, the first and second sections being movable about a hinge portion between first and second resting states. The seal member has an internal surface that in one resting state is directed at least in part radially outward. The seal member may also have a first outer surface that touches a second outer surface in one of the resting states.

33 Claims, 10 Drawing Sheets

FLIPPABLE SEAL MEMBER COAXIAL CABLE CONNECTOR AND TERMINAL

BACKGROUND OF THE INVENTION

1. Field of the Invention

The present invention relates generally to seals for coaxial cable connectors, and particularly to seals for sealing gaps at interfaces between coaxial cable connectors and terminals.

2. Technical Background

Coaxial cable connectors such as F-connectors are used to attach a coaxial cable to another object such as an appliance or junction having a terminal adapted to engage the coaxial cable connector. When used outdoors in weather-exposed areas it is desirable to prevent moisture from entering the terminal/connector/cable system. Various connectors are commercially available for outdoor applications and generally prevent moisture from entering the connector/cable junction. Such connectors must be attached to a coaxial cable using various cable preparation techniques and installation tools. Cable preparation typically requires removal of portion of the cable jacket, braid, outer conductor and core to expose the cable center conductor. Another portion of the cable jacket is removed to expose the cable braid. Cable preparation is often completed by folding of the cable braid structure back against the remaining cable jacket. The cable is then inserted into the connector, after which the connector is activated to secure the connector to the coaxial cable. For outdoor applications the connector is generally sealed to the cable either by the internal workings of the connector or by the use of an external sealant, heat shrinkable tubing, rubber cement, fusing tape or rubberized boot.

In order to maintain the integrity of the coaxial system, moisture must be prevented from entering the connector/appliance junction as well. In the past, others have attempted to provide a connector/appliance seal by using a rubber type material in the form of a tight fitting ring with an inner bore and an outer diameter or shape. For various reasons, the foregoing attempts have yielded less than satisfactory results. For example, attempts at encapsulating the connectors with tapes, shrink wrappings and plastic or rubber cements are too prone to installation errors, resulting in exposed seams and/or internal voids where moisture can collect and eventually penetrate to the cable junction. Moreover, shrink wrappings require the use of heat or chemicals which further complicate installation procedures. Cements require time to set up and cure, thus also prolonging and complicating installation procedures. The use of sealing components such as externally applied flexible boots and/or grommets again results in internal voids where moisture can collect. Installation of tight fitting seal rings is difficult and therefore many times is avoided. Subsequent removal of tight fitting seal rings after a lengthy period of service can be even more difficult than installation and oftentimes requires the use of a knife or similar instrument to cut the seal ring off of the appliance junction. This can likely result in damage to the junction threads and is not desirable. Additionally, existing seal rings are limited in use by the length of terminal port on which they are installed. A specific length seal ring must be matched with and installed on a terminal port of compatible length, thereby requiring the technician to recognize various port lengths and have a correct assortment of seal rings on hand. One example of a known seal ring is illustrated in FIG. 1. As illustrated, a seal ring 10 typically has a smooth outer surface 12 and a first internal bore 14 that is slightly smaller than the diameter of the threaded section 16 of terminal 18. Terminal 18 projects out from a wall surface, for example the exterior surface of an electrical or electronic device. This seal ring 10 also has a second internal bore 20 that has a diameter slightly smaller than the coupling nut 22 associated with coaxial cable connector 24. In this manner, a tight seal may be achieved by the tight fit between the seal ring 10 and, at each end, the coupling nut 22 and the threaded section 16 of terminal 18.

However, this and many of the known seal rings cover substantially most of the threads on the appliance port and require that at least a portion of the corresponding cable connector coupler engage the seal ring while engaging the port threads. This engagement of the seal ring can cause difficulty in turning the connector coupler, making the connector hard to install.

SUMMARY OF THE INVENTION

Disclosed herein is a flippable seal member for use with a coaxial cable connector and a terminal to seal an interface between the coaxial cable connector and the terminal, and the flippable seal member includes a seal body comprising a first section having a first outer surface and a second section having a second outer surface, wherein the first section is capable of being flipped toward the second section such that at least a portion of the first outer surface contacts the second outer surface. The flippable seal member can be deployed as a flip-up seal member or a flip-down seal member.

In some embodiments, the seal member has a first resting state and a second resting state, and in the second resting state, at least a portion of the first outer surface is perpendicular to at least a portion of the second outer surface.

In some embodiments, the seal body has a hinge portion disposed between the first and second sections and in other embodiments the seal body has a flexure region.

In another aspect, a flippable seal member seal member is disclosed herein for use with a coaxial cable connector and a terminal to seal an interface between the coaxial cable connector and the terminal, the flippable seal member including a seal body comprising a first section having a first outer surface and a second section having a second outer surface, wherein, in a first resting state, the first outer surface and the second outer surfaces face radially outwardly; and wherein, in a second resting state, at least a portion of the first outer surface contacts the second outer surface.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
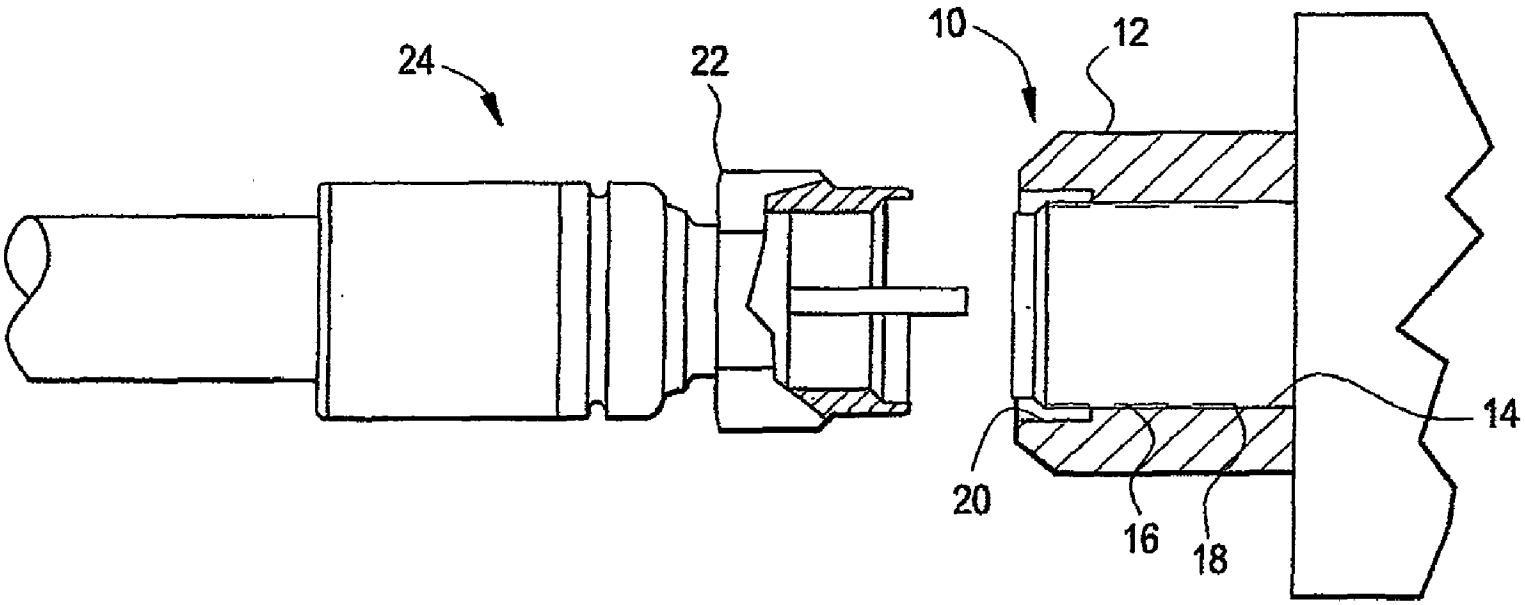
FIG. 1 PRIOR ART
FIG. 1 illustrates in partial cross section a prior art seal installed on a terminal with a coaxial cable connector positioned to be connected to the terminal.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
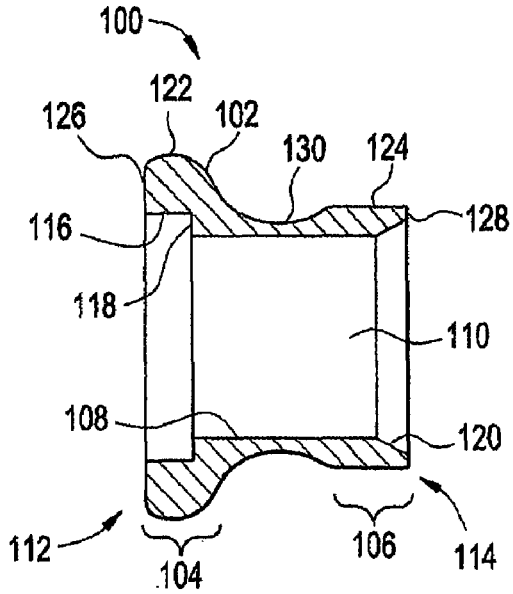
FIG. 2 is a cutaway view of the flippable seal member of one embodiment of flippable seal member as disclosed herein in a first resting state.

Referring to FIG. 2, the seal member 100 comprises a generally tubular seal body 102 that has a first section 104 and a second section 106. The seal body 102 has an internal surface 108 defining an opening 110 between a first end 112 and a second end 114. By generally tubular, we mean that the internal surface 108 and/or the external surface of the seal body can have one or a plurality of diameters and/or cross-sectional shapes. Opening 110 preferably has an enlarged portion 116 adjacent first end 112, the enlarged portion 116 of opening 110 also preferably includes a forward facing annular face 118. Adjacent second end 114, the seal body 102 preferably has a rearward facing internal chamfered portion 120 to assist with inserting a connector. The first section 104 of seal body 102 has a first outer surface 122 and the second section 106 of seal body 102 has a second outer surface 124. As illustrated in FIG. 2, the end 112 has a diameter and tubular wall thickness that is larger than the diameter and thickness at the second end 114. The first end 112 has a first axial end surface 126 and second end 114 has a second axial end surface 128. Disposed between the first section 104 and the second section 106 is a hinge portion 130. The hinge portion 130 preferably has a reduced tubular wall thickness preferably with an outer diameter that is smaller than the outer diameter of the seal body 102 at both the first and second ends 112,114.

The seal member 100 is illustrated in FIG. 2 as being in a first resting state. That is, the seal member 100 will remain as illustrated in FIG. 2 unless it is acted upon by some outside force, i.e., a user or an installer. In this first resting state, first section 104 and the second section 106 are generally parallel to one another, as are the first and second axial end surfaces 126,128. In this first resting state, the first and second outer surfaces 122,124 face radially outward.

The seal member 100 is preferably molded from a rubber-like material such as EPDM, vinyl, or a like material. It is also preferably treated to resist the deleterious effects of ultraviolet light so that it maintains resiliency after being outside for extended periods of time.

Figure 3:
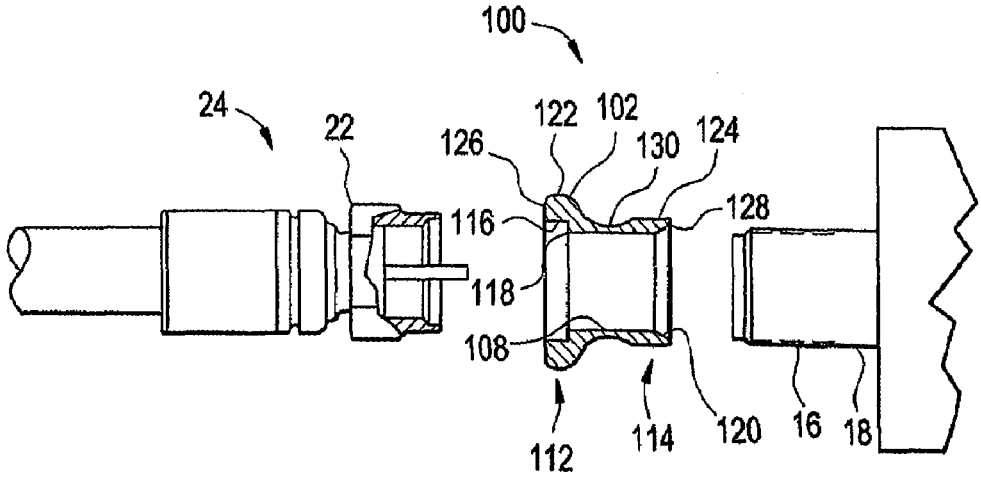
FIG. 3 illustrates a cutaway view of one embodiment of flippable seal member of FIG. 2 prior to installation onto a coaxial cable connector and a terminal.

The opening 110 at second end 114 is preferably slightly smaller than the terminal 18 on which it is to be installed. As illustrated in FIG. 3, the second end 114 will engage the terminal 18, while first end 112 will engage the coaxial cable connector 24 and, in particular, the coupler such as coupling nut 22. Similarly, the diameter of the enlarged portion 116 of opening 110 adjacent first end 112 is preferably smaller than an outermost diameter of the coupling nut 22.

Figure 4:
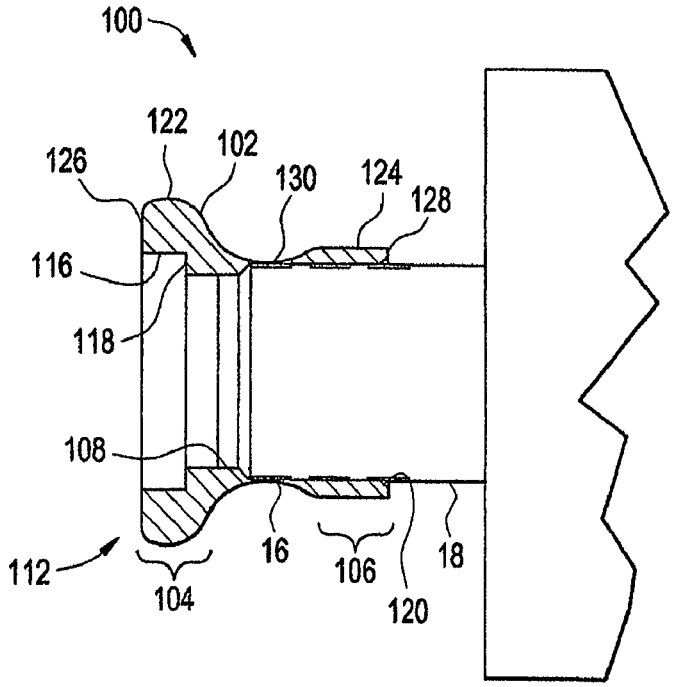
FIG. 4 is a cutaway view of the flippable seal member of FIG. 2 installed on a terminal.

The installation of seal member 100 will now be described in conjunction with FIG. 4. As noted above, second end 114 is aligned with the threaded section 16 of terminal 18. The rearward facing internal chamfer portion 120 assists in directing the threaded section 16 of terminal 18 into the opening 110 of seal body 102. As the opening 110 is slightly smaller in diameter at the second end 114 than the diameter of the threaded section 16, the seal member 100 is stretched slightly to accommodate the larger diameter of the threaded section 16 and to sealingly engage the seal member 100 to the terminal 18. The enlarged diameter of the body member 102 at first end 112, which provides for an increased thickness at the first section 104, and the first axial end surface 126 also provides an adequate surface area for leverage for the user to grip and to install the seal member 100 on the terminal 18.

Figure 5:
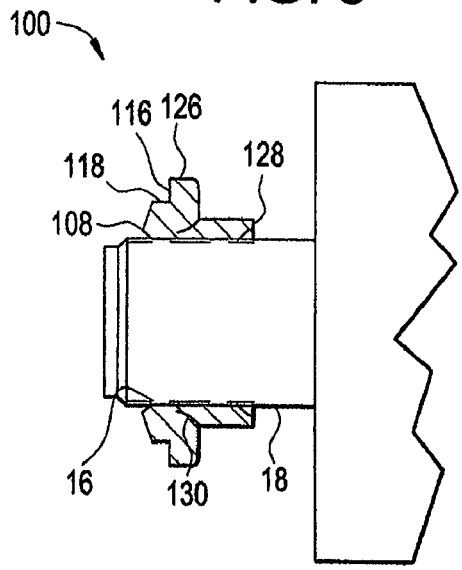
FIG. 5 is a cutaway view of the flippable seal member of FIG. 2 partially installed on a terminal in a second resting state.
Figure 6:
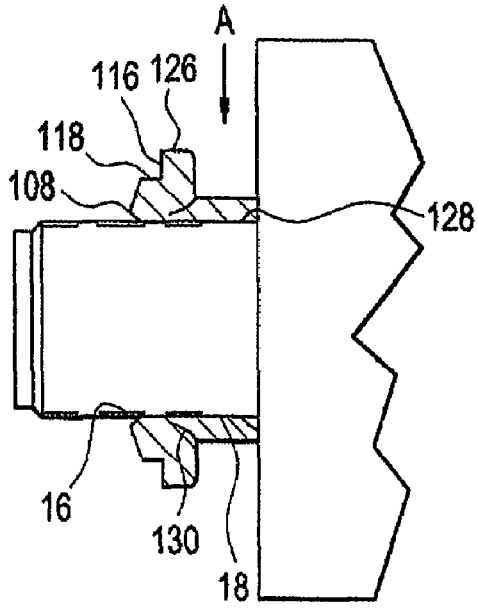
FIG. 6 is a cutaway view of the flippable seal member of FIG. 2 fully installed on a terminal.
Figure 7:
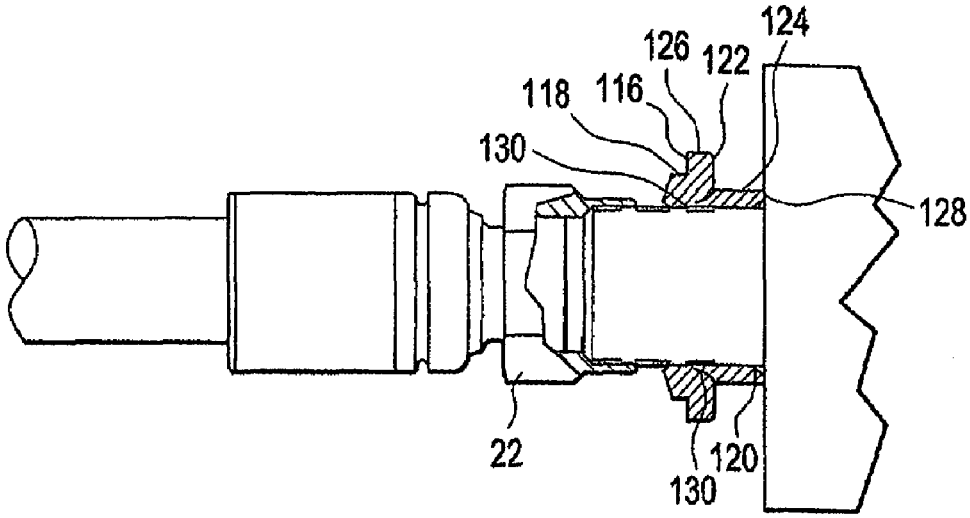
FIG. 7 is a partial side cutaway view of the flippable member of FIGS. 2-6 with the coaxial cable connector installed on the terminal.
Figure 8:
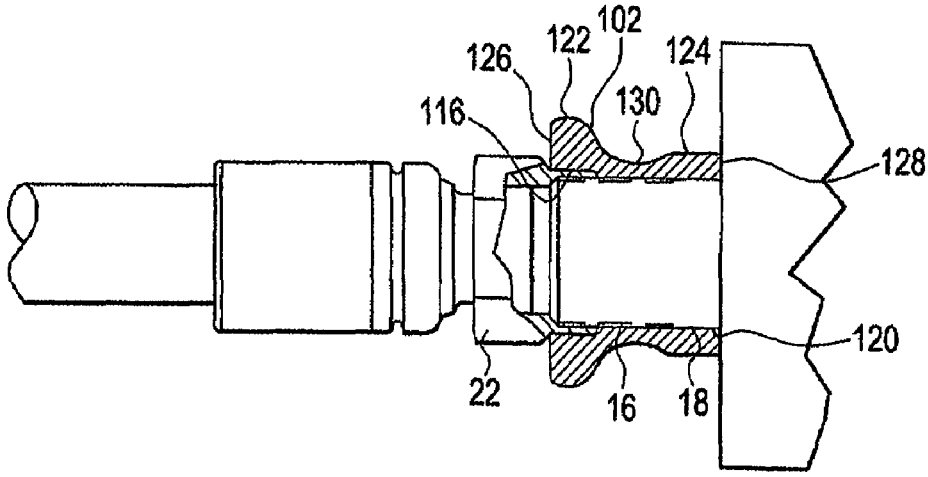
FIG. 8 is a partial side cutaway view of the flippable member of FIGS. 2-7 fully installed to seal the interface of the coaxial cable connector and the terminal.

As the seal member 100 is pushed onto terminal 18, the user can, as illustrated in FIG. 5, flip the first end 112 about hinge portion 126 towards the second end 114, i.e. the seal member 100 is flipped up from a first resting state to a second resting state. In this second resting state, at least a portion of the first outer surface 122 of the first section 104 touches the second outer surface 124 of the second section 106. As with the first resting state, seal member 100 will remain in the second resting state until again acted upon by an outside force, e.g., a user or an installer, i.e. until flipped down. As illustrated in FIG. 5, at least a portion of the internal surface 108 is exposed in the second resting state but does not touch the first or second outer surfaces 122,124. The first axial end surface 126 is now directed radially outward. The exposed internal surface 108 as well as the enlarged portion 116 provide a surface against which a user may push the seal member 100 further along terminal 18 as illustrated in FIG. 6 thereby increasing the torque available to twist and/or slide the seal member 100 onto the terminal. In this position, the seal member 100 sealingly engages the terminal 18 as well as the threaded section 16. However, a portion of the threaded section 16 is visible and available to the coaxial cable connector 24. In contrast to known sealing members, the coaxial cable connector 24 may be easily threaded onto the threaded section 16 without interference or contact from the seal member 100. Once the coaxial cable connector 24 is fully engaged on terminal 18, the user may flip the first section 104 back from the second resting state to the first resting state as illustrated in FIG. 8. As illustrated in both FIGS. 6 and 7 at least some of the outer surface of the second section is exposed, i.e. not covered by the first section, so as to provide sufficient space A between the exterior surface or wall of a device or other object from which the terminal 18 extends and the first end 112 to allow a user to insert a tool or fingers to flip the first section 104 back to the first resting state.

As illustrated in FIG. 8, the first section 104 engages the coupling nut 22 of the coaxial cable connector 24. More specifically, the enlarged portion 116 of the opening 110 engages the coupling nut 22. It should be noted, however, that seal member 100 need not have a large portion 116 of opening 110 adjacent the first end 112 of seal body 102. Since a seal member 100 is preferably molded from a rubber-like material, seal member 100 preferably generally conforms to the configuration of the coaxial cable connector 24, and more particularly, the coupling nut 22.

Figure 9:
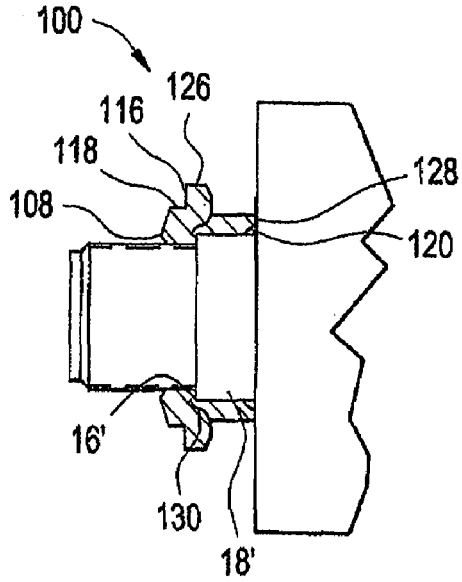
FIG. 9 is a cutaway view of the flippable seal member of FIG. 2 partially installed on an alternative terminal and in the second resting state.

Similarly, as illustrated in FIG. 9, seal member 100 may conform to a terminal 18' that has an enlarged portion 16' adjacent the threaded portion 16. Since seal member 100 is deformable, the second section 106 will accommodate the enlarged portion 16'.

Figure 10:
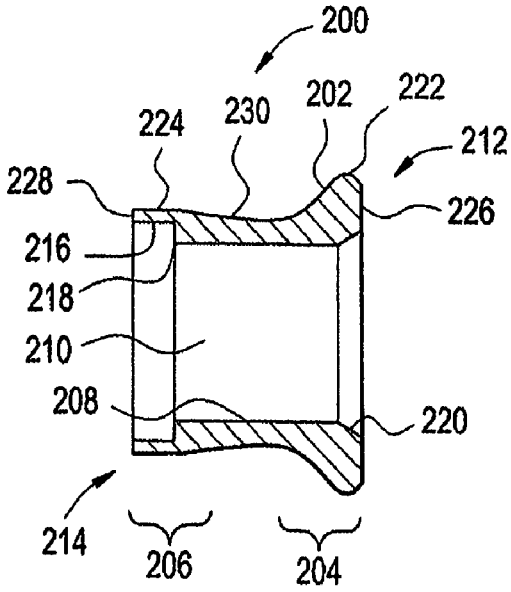
FIG. 10 a cutaway view of another embodiment of flippable seal member as disclosed herein.

Another embodiment of a generally tubular seal member 200 is illustrated in FIG. 10. Seal member 200 comprises a seal body 202 and has a first section 204 and a second section 206. The seal body 202 has an internal surface 208 defining an opening 210 between a first end 212 and a second end 214. Opening 210 preferably has an enlarged tubular wall thickness portion 216 adjacent the second end 214, the enlarged portion 216 of opening 210 also preferably includes a forward facing annular face 218. Adjacent first end 212, the seal body 202 preferably has a rearward facing internal chamfer portion 220 to assist with inserting a connector. The first section 204 of seal body 202 has a first outer surface 222 and the second section 206 of seal body 202 has second outer surface 224. As illustrated in FIG. 10, the first end 212 has an outer diameter and a tubular wall thickness that are larger than at the second end 214. The first end 212 has a first axial end surface 226 and second end 214 has a second axial end surface 228. Disposed between the first section 204 and the second section 206 is a hinge portion 230. The hinge portion 230 preferably has a reduced outer diameter, an outer diameter that is smaller than the outer diameter of the seal body 202 at both the first and second ends 214,216.

As in the previous embodiment, seal member 200 is illustrated in FIG. 10 as being in a first resting state. That is, the seal member 200 will remain as illustrated in FIG. 10 unless it is acted upon by some outside force, i.e., a user or an installer. In this first resting state, first section 204 in the second section 206 are generally parallel to one another, as are the first and second axial end surfaces 226,228. In this first resting state, the first and second outer surfaces 222,224 face radially outward.

The seal member 200 is preferably molded from a rubber-like material such as EPDM, vinyl, or a like material. It is also preferably treated to resist the deleterious effects of ultraviolet light so that it maintains resiliency after being outside for extended periods of time.

Figure 10A:
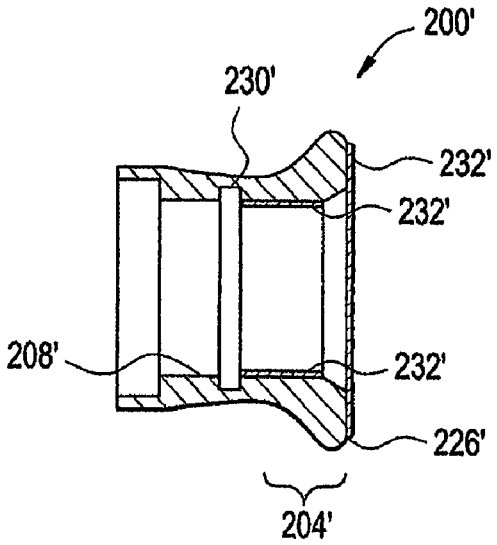
FIG. 10A is an alternative embodiment of the flippable seal member of FIG. 10.

Another embodiment of a seal member 200' is illustrated in FIG. 10A. Seal member 200' is similar to seal member 200, but has the hinge portion 230' in the internal surface 208' of seal member 200'. Hinge portion 230' is illustrated as being a sharp groove, but it could also be more rounded and smooth. As with the other embodiments, the seal member 200' preferably has a reduced tubular wall thickness at hinge portion 230'. An internal hinge portion, like hinge portion 230', may also be used in seal member 100, rather than the hinge portion 130 as discussed above. Seal member 200' also preferably includes indicia, a reflective surface, and/or contrasting colors to allow an installer to quickly, as well as from a distance, determine the position or resting state of the seal members. As but one example, seal member 200' (or any of the other embodiments disclosed herein) may have the indicia 232' on the axial end surfaces, which is illustrated in FIG. 10A as a reflective coating or a different seal body color that is highly visible relative to the remainder of the seal member 200'. The indicia 232' may also be on internal surface 208', particularly at the first section 204', although it may cover any portion of the internal surface 208', including the entirety of the internal surface 208'. Thus, when the seal members are in the second resting state, the axial end surface (e.g., 226') and a portion of the internal surface (e.g., 208') will face radially outward (see, e.g., FIGS. 9 and 12) allowing the installer to view the indicia 232', particularly if a strong light is shone on it. If the seal members are in the first resting state, then the indicia 232' is not readily visible due to contact of the seal member with the terminal or the connector (see, e.g., FIGS. 8 & 14). The indicia 232', although illustrated in FIG. 10A as covering the entirety of axial end surface 226', may cover either or both axial ends, only a portion thereof, and may take any form or be of any size. Similarly, the indicia 232' may be on at least a portion of the first outer surface of the seal member so that it is covered when the seal member is in the second resting state and uncovered in the first resting state. Thus, in some embodiments, the first section has a first inner surface, wherein the first inner surface is visually distinguishable from the first outer surface by a visually detectable difference in color, shading, coating, or finish between the first inner surface and the first outer surface. In other embodiments, the first section has a first end surface, wherein the first end surface is visually distinguishable from one or both of the first outer surface and the first inner surface by a detectable difference in color, shading, coating, or finish. In other embodiments, the first section further comprises a first inner surface and a first end surface, and the second section further comprises a second inner surface and a second end surface, and the first inner surface is visually distinguishable from at least one of the group consisting of the first outer surface, the first end surface, the second outer surface, the second inner surface, and the second end surface, by a detectable difference in color, shading, coating, or finish. In other embodiments, either the first end surface is visually distinguishable from other surfaces such as the first outer surface or the first inner surface or the or the second outer surface or the second inner surface or the second end surface by a detectable difference in color, shading, coating, or finish.

Figure 11:
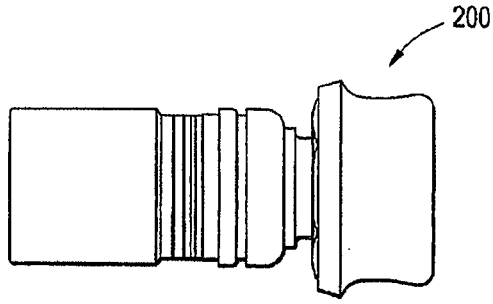
FIG. 11 is an elevational view of the flippable seal member of FIG. 10.
Figure 12:
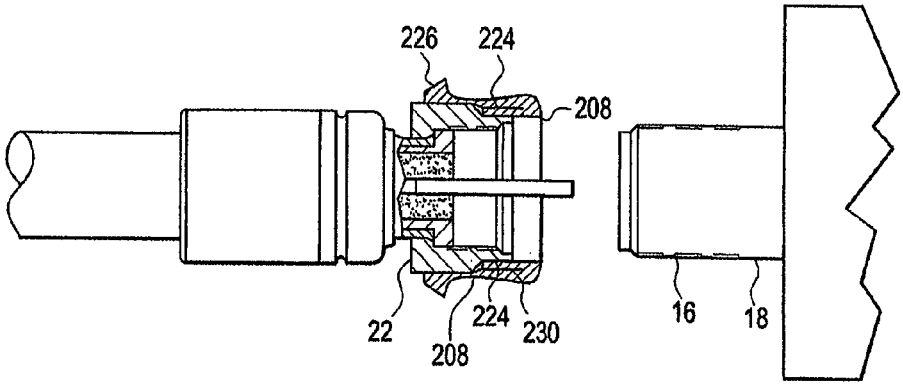
FIG. 12 is a cutaway view of the flippable seal member of FIG. 10 installed on a coaxial cable connector, the seal member in a second resting state.

Seal member 200 has an opening 210 is preferably slightly smaller than the coaxial cable connector 24 on which is to be installed. As illustrated in FIGS. 11 and 12, the seal member 200 is preferably installed on the coupling nut 22 of the coaxial cable connector 24 rather than on the threaded section 16 of terminal 18. Similarly, the second end 214 of the seal number 200 is disposed over the coupling nut 22. The enlarged portion 216 of opening 210 adjacent the second end 214, which is slightly smaller in diameter than the coupling nut 22, snugly engages coupling nut 22 to prevent moisture from entering therebetween. After seal member 200 is pushed on to coaxial cable connector 24, the first end 212 is flipped about hinge portion 230 towards the second end 214. The larger diameter and thickness of the first outer surface 222 allows the flipping of the first end 212 towards the second end 214 with relative ease. The seal member 200 is illustrated in the FIGS. 11 and 12 in the second resting state. In the second resting state, at least a portion of the first outer surface 222 is in contact with a portion of second outer surface 224. It is also true that the second outer surface 224 is pointing radially outward while at least a portion of the first outer surface 222 is pointing radially inward. Also in this position, at least a portion of internal surface 208 is directed radially outward and presents an increased diameter grasping surface for a user thereby allowing greater ease of applying torque for twisting seal member 200 or ease of sliding the seal member 200.

Figure 13:
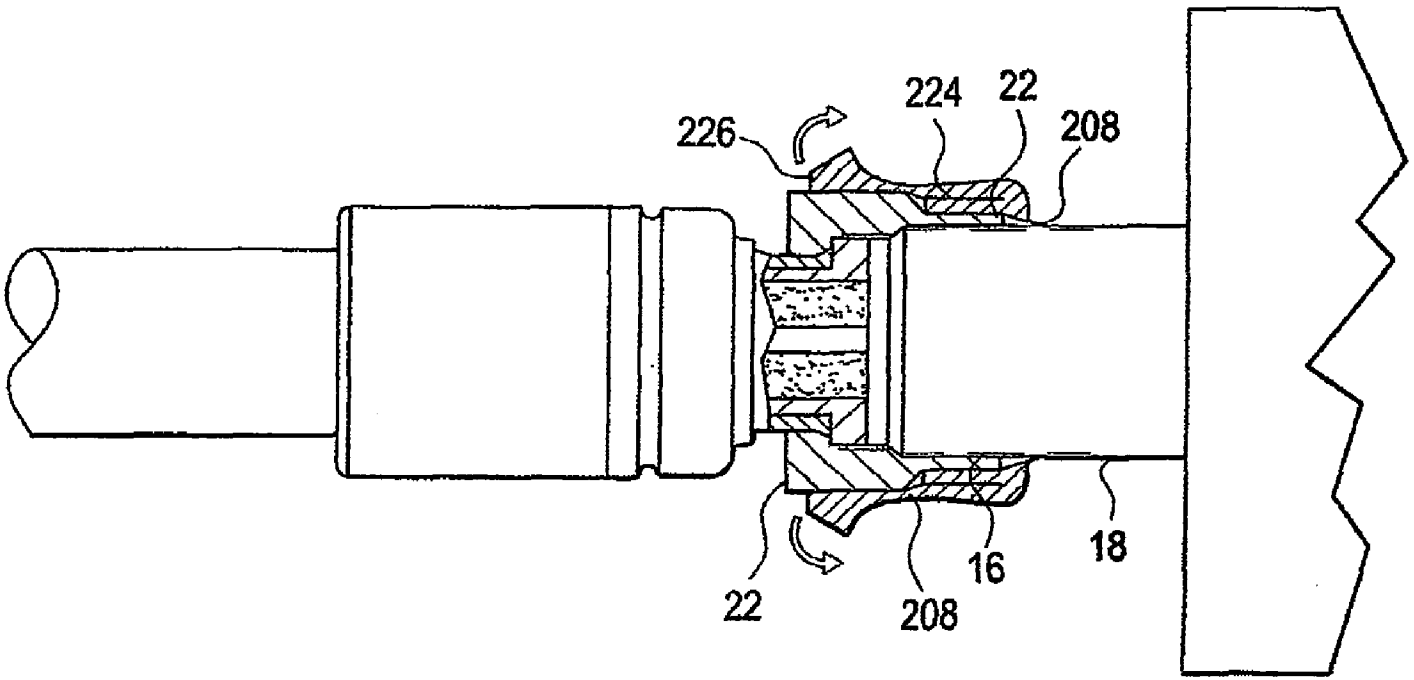
FIG. 13 is a partial side cutaway view of the flippable seal member of FIG. 10 with the coaxial cable connector installed on the terminal.

The combination of the coaxial cable connector 24 in the seal member 200 are then installed on the threaded portion 16 of terminal 18 as illustrated in FIG. 13. Because the internal surface 208 presents an enhanced grasping surface for the user, the user can simply rotate the coupling nut 22 along with the seal member 200 until the coaxial cable connector 24 is fully installed on the terminal 18.

Figure 14:
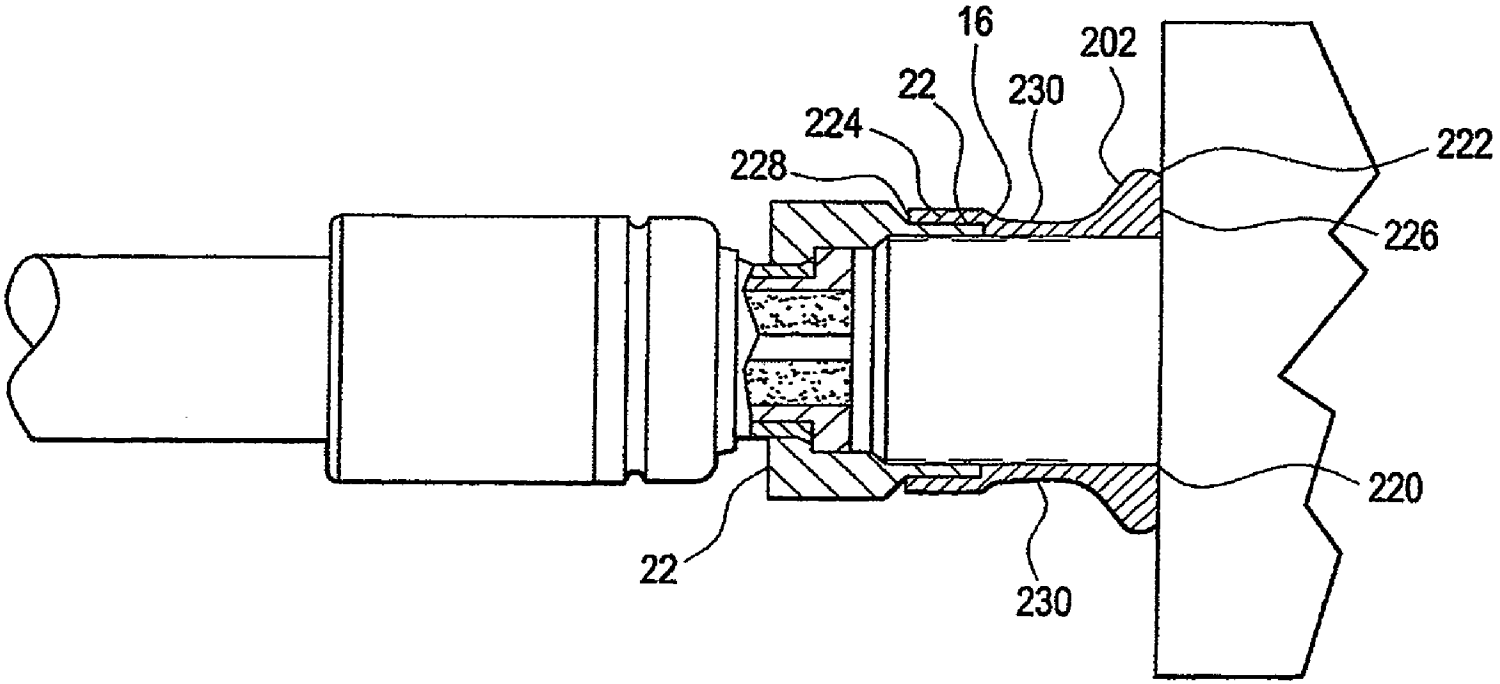
FIG. 14 is partial side cutaway view of the flippable seal member of FIG. 10 fully installed to seal the interface of the coaxial cable connector and the terminal.

The user can then, as illustrated by the arrows in FIG. 13, flip the first end 212 back about the hinge portion 226 to cover and engage the exposed threaded portion 16 of terminal 18. As illustrated in FIG. 14, the first end 212 engages terminal 18 and a portion of internal surface 208 engages the threaded portion 16 to keep the moisture from entering therein.

Figure 15:
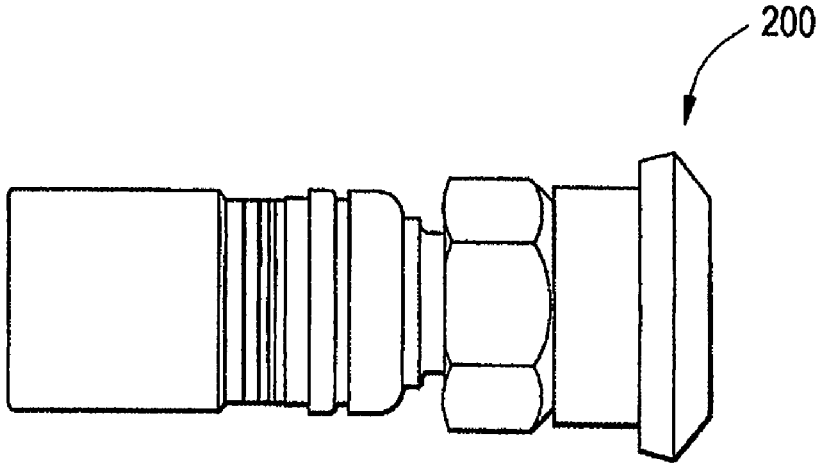
FIG. 15 is an elevational view of a flippable seal member in another second resting position.

In the event that the user would need a tool to rotate the coupling nut 24 of the coaxial cable connector 22, the first end 212 does not need to be flipped back as far as illustrated in FIGS. 11 and 12, but might only need to be flipped back partially, as illustrated in FIG. 15.

Thus, the flippable seal member can provide terminal/connector junction sealing and can be easily installed, and can be made to cover a range of terminal port lengths; the seal member can allow easier turning of the connector coupler during installation yet can provide resistance to coupler rotation after the installation is complete.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A flippable seal member for use with a coaxial cable connector and a terminal, the flippable seal member comprising:

a generally tubular seal body comprising a first section having a first outer surface and a second section having a second outer surface, wherein the first section is capable of being flipped toward the second section such that at least a portion of the first outer surface contacts the second outer surface.

2. The seal member of claim 1 wherein the first section has a first inner surface, and wherein the first inner surface does not contact the first outer surface.

3. The seal member of claim 1 wherein the first section comprises an increased tubular wall thickness region.

4. The seal member of claim 1 wherein, in a first resting state, the first section is not flipped toward the second section, and wherein, in a second resting state, the first section is flipped toward the second section.

5. The seal member of claim 4 wherein the first section further comprises a first axial end surface and the second section further comprises a second axial end surface, wherein the first and second axial end surfaces do not contact each other in the first resting state, and wherein the first and second axial end surfaces do not contact each other in the second resting state.

6. The seal member of claim 1 wherein the first section, in a first resting state, is generally parallel to the second section, and wherein the first section, in a second resting state, is generally perpendicular to the second section.

7. The seal member of claim 1 wherein the first section further comprises a first axial end surface and the second section further comprises a second axial end surface, wherein, in a first resting state, the first axial end surface is generally parallel to the second axial end surface, and wherein the first axial end surface, in a second resting state, is generally perpendicular to the second axial end surface.

8. The seal member of claim 1 wherein the seal body further comprises a hinge portion disposed between the first and second sections.

9. The seal member of claim 8 wherein the hinge portion comprises a reduced thickness tubular wall region.

10. The seal member of claim 8 wherein the hinge portion comprises an outer surface provided with a groove.

11. The seal member of claim 8 wherein the hinge portion comprises an inner surface provided with a groove.

12. The seal member of claim 8 wherein the hinge portion comprises a flexure region, wherein the first section bends with respect to the second section about the flexure region.

13. A flippable seal member for use with a coaxial cable connector and a terminal, the flippable seal member comprising:

a generally tubular seal body comprising a first section having a first outer surface and a second section having a second outer surface, wherein, in a first resting state, the first outer surface and the second outer surfaces face radially outwardly; and wherein, in a second resting state, at least a portion of the first outer surface contacts the second outer surface.

14. The seal member of claim 13 wherein the first section has a first inner surface, wherein the first inner surface does not contact the first outer surface in the first resting state, and wherein the first inner surface does not contact the first outer surface in the second resting state.

15. The seal member of claim 13 wherein the first section comprises an increased tubular wall thickness region.

16. The seal member of claim 13 wherein, in the second resting state, all of the second outer surface is covered by the first outer surface.

17. The seal member of claim 13 wherein, in the second resting state, at least a portion of the first outer surface is disposed perpendicular to at least a portion of the second outer surface.

18. The seal member of claim 13 wherein the first section comprises a first axial end surface, wherein, in the second resting state, the first axial end surface faces radially outwardly.

19. The seal member of claim 13 wherein the first section further comprises a first inner surface, wherein, in the first resting state, the first inner surface faces radially inwardly, and wherein, in the second resting state, at least a portion of the first inner surface faces radially outwardly.

20. The seal member of claim 13 wherein the first section comprises a first axial end surface and the second section comprises a second axial end surface, wherein, in the first resting state, the first and second axial end surfaces are generally parallel to each other, and wherein, in the second resting state, the first and second axial end surfaces are generally perpendicular to each other.

21. The seal member of claim 13 wherein the first section comprises a first axial end surface and the second section comprises a second axial end surface, wherein, in the first resting state, the first and second axial end surfaces face away from each other, and wherein, in the second resting state, the first and second axial end surfaces face generally in the same direction.

22. The seal member of claim 13 wherein the seal body further comprises a hinge portion disposed between the first and second sections.

23. The seal member of claim 22 wherein the hinge portion comprises a reduced tubular wall thickness region.

24. The seal member of claim 22 wherein the hinge portion comprises an outer surface provided with a groove.

25. The seal member of claim 22 wherein the hinge portion comprises an inner surface provided with a groove.

26. The seal member of claim 22 wherein the hinge portion comprises a flexure region, wherein the first section bends with respect to the second section about the flexure region.

27. The seal member of claim 13 wherein, in the first resting state, the first section contacts the terminal and the second section contacts the connector.

28. The seal member of claim 27 wherein, in the second resting state, the second section does not contact the terminal.

29. The seal member of claim 27 wherein in the second resting state, the second section contacts the connector and does not contact the terminal.

30. The seal member of claim 13 wherein, in the first resting state, the first section contacts the connector and the second section contacts the terminal.

31. The seal member of claim 30 wherein in the second resting state, the second section does not contact the connector.

32. The seal member of claim 13 wherein the first section has a first inner surface, wherein the first inner surface is visually distinguishable from the first outer surface by a visually detectable difference in color, shading, coating, or finish.

33. The seal member of claim 13 wherein the first section further comprises a first inner surface and a first end surface, and wherein the second section further comprises a second inner surface and a second end surface, wherein the first inner surface is visually distinguishable from at least one of the group consisting of the first outer surface, the first end surface, the second outer surface, the second inner surface, and the second end surface, by a detectable difference in color, shading, coating, or finish.

* * * * *